US008267626B2

(12) United States Patent
Claas et al.

(10) Patent No.: US 8,267,626 B2
(45) Date of Patent: Sep. 18, 2012

(54) TRANSPORTATION UNIT WITH AN ALIGNMENT UNIT FOR A VEHICLE

(76) Inventors: Benedikt Claas, Northeim (DE); Dix Claas, Northeim (DE)

( * ) Notice: Subject to any disclaimer, the term of this patent is extended or adjusted under 35 U.S.C. 154(b) by 233 days.

(21) Appl. No.: 12/808,563

(22) PCT Filed: Oct. 27, 2008

(86) PCT No.: PCT/EP2008/009054

§ 371 (c)(1),
(2), (4) Date: Jun. 16, 2010

(87) PCT Pub. No.: WO2009/083055

PCT Pub. Date: Jul. 9, 2009

(65) Prior Publication Data

US 2010/0278607 A1 Nov. 4, 2010

(30) Foreign Application Priority Data

Dec. 21, 2007 (DE) ..... 10 2007 062 324

(51) Int. Cl.
*B60P 7/00* (2006.01)

(52) U.S. Cl. ..... 410/1; 410/4

(58) Field of Classification Search ..... 410/1, 4, 410/6, 67; 104/44–46; 414/339; 105/372, 105/455

See application file for complete search history.

(56) References Cited

U.S. PATENT DOCUMENTS 2,190,708 A 2/1940 Fowler
2,782,733 A 2/1957 Ewing
4,948,310 A * 8/1990 Ord ..... 410/1

FOREIGN PATENT DOCUMENTS

DE 102006022674 A1 6/2007
GB 2198405 A 6/1988

* cited by examiner

*Primary Examiner* — Stephen Gordon
(74) *Attorney, Agent, or Firm* — Laurence A. Greenberg; Werner H. Stemer; Ralph E. Locher

(57) ABSTRACT

A transportation unit, such as a wagon and/or train, includes at least one plate-shaped alignment unit, which can rotate about a vertical axis, for picking up a vehicle from a ramp and aligning it. The length of the vehicle exceeds a useful width of the transportation unit, but the width of the vehicle does not project beyond the transportation unit. The alignment unit is mounted on the floor of the transportation unit so as to rotate on a carrier track. The transportation unit carries respective flaps which can pivot onto the ramp or ramps and onto which the carrier tracks extend and as a result also support the alignment unit in a rotated, partially projecting-out state at that location.

25 Claims, 14 Drawing Sheets

TRANSPORTATION UNIT WITH AN ALIGNMENT UNIT FOR A VEHICLE

BACKGROUND OF THE INVENTION

Field of the Invention

The invention relates to a transportation unit, such as a wagon and/or train, with at least one plate-shaped alignment unit, which can rotate about a vertical axis, for taking a vehicle from a ramp and aligning it, the length of which vehicle exceeds a usable width of the transportation unit, but the width of which vehicle does not project beyond said transportation unit.

Such a transportation unit is known from DE 10258405 A1. Its plate-shaped alignment unit has wheels at the bottom side, by means of which it is moved on the wagon floor and the ramp when it is rotated. During this movement the gap between the wagon floor and the ramp has to be bridged. For this purpose, the alignment unit is pulled out in sections, which are guided in such a way that they slide against each other, while the wheels are lifted off. This lifting and sliding structure requires a bearing at the center of motion with the capacity to support a large load, resulting in significant weight and height.

BRIEF SUMMARY OF THE INVENTION

It is an object of the invention to create a low-profile, simpler transportation unit, which can easily be accessed by the vehicle that is to be transported.

The object is achieved in that the alignment unit is mounted on the floor of the transportation unit so as to rotate on a carrier track, and the transportation unit is fitted with flaps, which can pivot onto the ramp or ramps respectively, and onto which the carrier tracks extend, which as a result also supports the alignment unit in this area, when it is rotated and partially projecting.

Advantageous embodiments are specified in the dependent claims.

By using side flaps of a transportation unit for the loading process, various advantageous features are obtained:

1. The alignment unit has a larger surface during the loading operations. This way, goods which are longer than the width of a transportation unit in its running state, can be positioned more easily.
2. The flaps have the function of bridging the gap between the transportation unit and a ramp.
3. A carrier track for the alignment unit is mounted in the side flaps/loading flaps.

When the side flaps are opened, the mobile parts of the side flaps and the base of the transportation unit form a larger mobile surface. This mobile unit allows to move/turn material located on its surface in the desired direction. Since this surface is wider than the transportation unit, longer items can be loaded without problems. For the train to be ready to start, the side flaps are closed along with the moving parts, which are now treated in their additional function as a part of a side flap. The alignment unit is fixed when the side flaps are closed.

It is possible to use alignment units in multi-level loading units, if appropriate multi-level ramps are available. As the train always stops in the same position, columns for the upper ramp can be set up where there are no flaps.

Individual special wagons (toilets, stairs, shopping etc.) are coupled in between in some places.

For moving the alignment unit, an engine is mounted at the fixed base or body underneath the floor, which allows a continuous circular movement of the alignment unit in both directions, preferably by means of a toothed ring, which is mounted below the alignment unit. An electric control that is connected to the engine serves to control the alignment unit from any place inside or outside of the train, for example by remote control. The alignment unit is integrated in the floor and the side walls of a transportation unit, and the floor and the side walls can partly be replaced by it. The alignment unit is located on carrier tracks which are fixed on the floor/the body and the flaps. The carrier tracks are circular. The alignment unit can be turned on the tracks, either sliding or by means of rollers. The alignment unit is enclosed by a surrounding ring, so that it always remains in contact with the carrier track in the case of shocks or other vertical movements. A protective sleeve that is mounted above it keeps dirt away.

The alignment unit can be added to an existing vehicle. The alignment unit can consist of one piece, if it is flexible enough in the appropriate regions, for example because of thinner or different material, so that it can be moved with the side walls.

The way the alignment unit is set up ensures that it is flat at all times during the loading process, and that there are no breaks in the form of gaps or holes within the entire area of the transportation unit with its side flaps open, thereby contributing significantly to safety.

The side flaps are opened and closed by mechanisms located in the side walls. For example, a nut block guided in a rail is moved up and down with a threaded rod by means of a rotating drive, the nut block is connected to the flap by a rod, so the flaps open and close. When the lower flap is open, the block, together with the rod, can be lowered to a floor level. Inside of the flap, the rod can be advanced further, and engages only when the nut block has reached a certain height. The end of the rod is T-shaped and engages in specially shaped hooks inside the flap. Their shape is such that the T-shaped end unlatches only when the flaps are open. The rods are sunk in recesses/openings in the flaps, so they are protected, and flatness is ensured.

Alternatively, a telescopic rod is mounted between the nut block and the flap. Instead of unlatching, it is telescoped and this way is recessed in the flap. A spring that is integrated in the rod keeps it at its respectively possible length.

Alternatively, a multistage hydraulic cylinder is used, which is placed between the flap and a place in the side wall. It can not be recessed but can be covered. A threaded rod is obsolete.

Besides the lower flaps which can be pivoted onto the ramp, upper flaps are advantageously placed at the roof edge or at a middle plate. These flaps are equipped with pivot devices similar to those at the lower flaps. They can be operated with the same threaded rod with an inverse thread. A drive moves the two superposed flaps simultaneously. When the upper flaps are open, the rod is not recessed.

The closing edges/areas of the upper and lower flaps are advantageously trapezoidal. After they are latched by means of bolts, whereby the locking edges are held against each other, they are stabilized, secure and isolate against external influences.

The bolts lock after the flaps have been closed by the closing-opening mechanism.

A flap for driving on and off is advantageously hinged on the lower flap and is supported by springs that are attached underneath, so it is pressed against the upper flap or against the ramp or in a desired angular position.

Advantageously, a driver is in the car during the entire loading process and positioning aids help him to drive on and off in the correct way. Display panels are integrated in the upper flaps, which are preferably swung out or extended when the flaps are open and which serve as traffic lights and visual aids for driving on and off.

Markings on the alignment unit indicate the correct parking position. Pressure sensors located between the markings in the floor or optical or electromagnetic sensors, together with the display panel serve as positioning aids.

Traffic lights and/or display panels, signaling to vehicles driving on or off are mounted in fixed wall segments next to the flaps at the outside and inside of the train.

An articulated train has one mobile unit per segment, section or wagon (in double-deck trains: two superimposed mobile units). As the segments are short, the width may be correspondingly large, in accordance with the clearance gauge.

The body of the train is lowered and the wheel case, which encloses the wheels with axle, drive, suspension, brake and coupling, is located partly above the level of the base plate. Due to the width of the train, there is room between the walls and the wheel cases. The level of the base plate can be continued into the next section of the train without obstacles, so that persons can walk here.

The axle is supported by two vertically mobile blocks with axle bearings, which are attached to the body by a hinge. Springs/shock absorbers are placed between block and wheel case as a suspension. The wheel cases are stable and take the spring load.

Hydraulic cylinders are fitted between the blocks and the wheel cases to ensure that the train does not vibrate during the loading process and that it is aligned to the height of the ramp. Ramp sensors control the hydraulic cylinders, enabling an automatic level adjustment.

An engine for driving the wheels is mounted to the block, and drives them via the axle. The train can be stopped either with the motor reversed to function as a dynamo, as a means of energy recovery, and/or with a brake.

By incorporating the side walls of a transportation unit, for example of a train, in the loading process, it is possible, due to the thus obtained greater maneuvering surface, to load any kind of goods, in particular goods with a length exceeding the width of the transportation unit, in a simple manner, very quickly, and independently and simultaneously at each loading position of the transportation unit, in particularly advantageous manner. When the side walls are open, supporting and/or mobile parts of the side walls and floor of the transportation unit jointly form a larger mobile alignment platform. This platform allows moving the material located on it in the desired direction. For the train to be ready to start, the side walls are closed along with the supporting and/or mobile parts, which can now be moved with the side walls.

The arrangement can be made in such a way, that the moving parts of the loading unit replace parts of the floor and the side walls.

BRIEF DESCRIPTION OF THE SEVERAL VIEWS OF THE DRAWING

FIG. 9*a* Top view of the body with carrier tracks in loading position.

DESCRIPTION OF THE INVENTION

Figure 1:
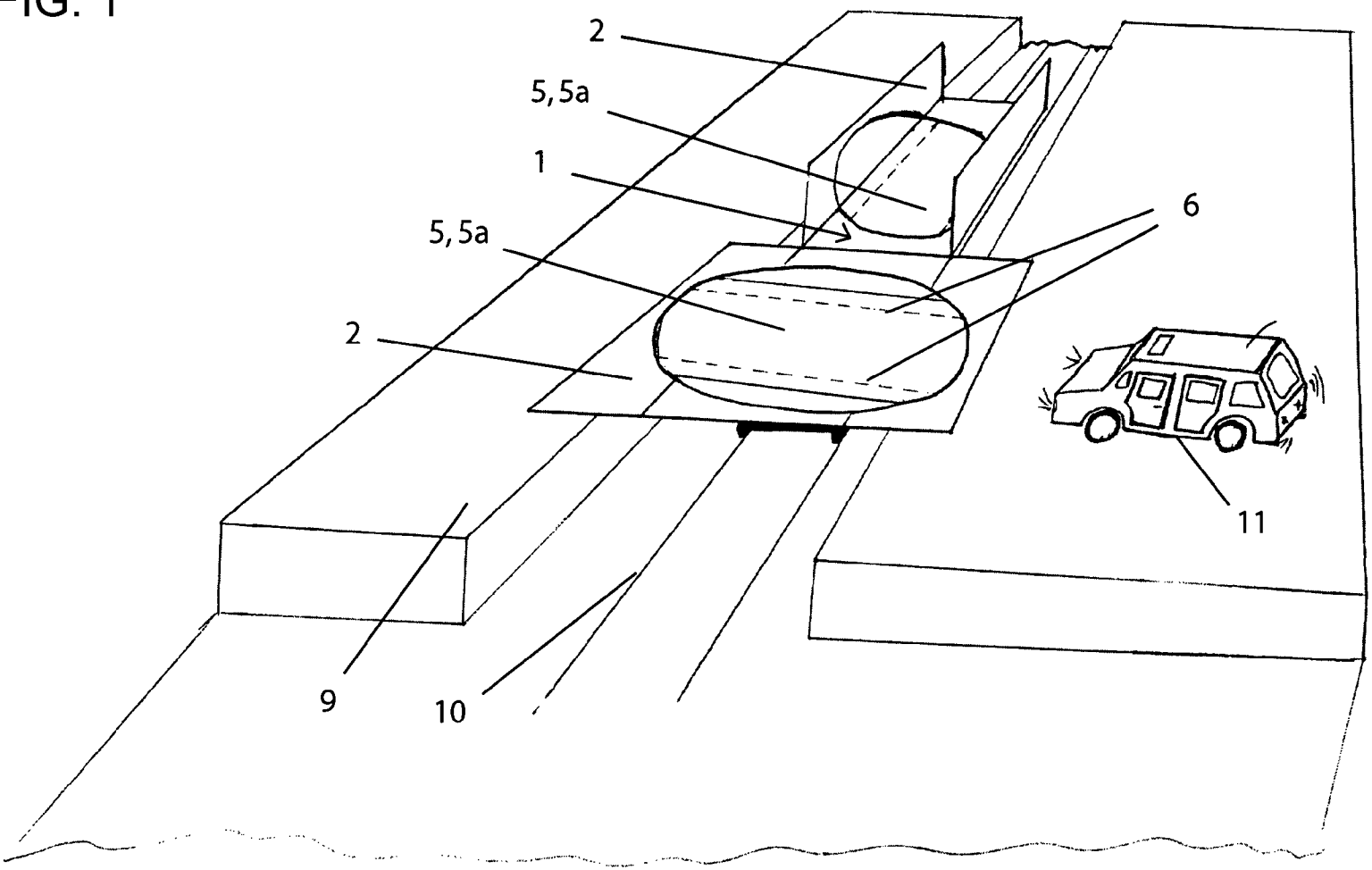
FIG. 1 Perspective view of a simple transportation unit between ramps.

FIG. 1 shows a transportation unit 1, which is located between two ramps 9 on a track 10. The drawing shows open lower flaps 2 in the front section of the transportation unit 1, and closed ones in the rear section. The alignment unit 5, 5*a* at the front is rotated so that a car 11 can drive on and of in a straight line between the ramp and the lines 6 limiting the driveway.

Figure 2:
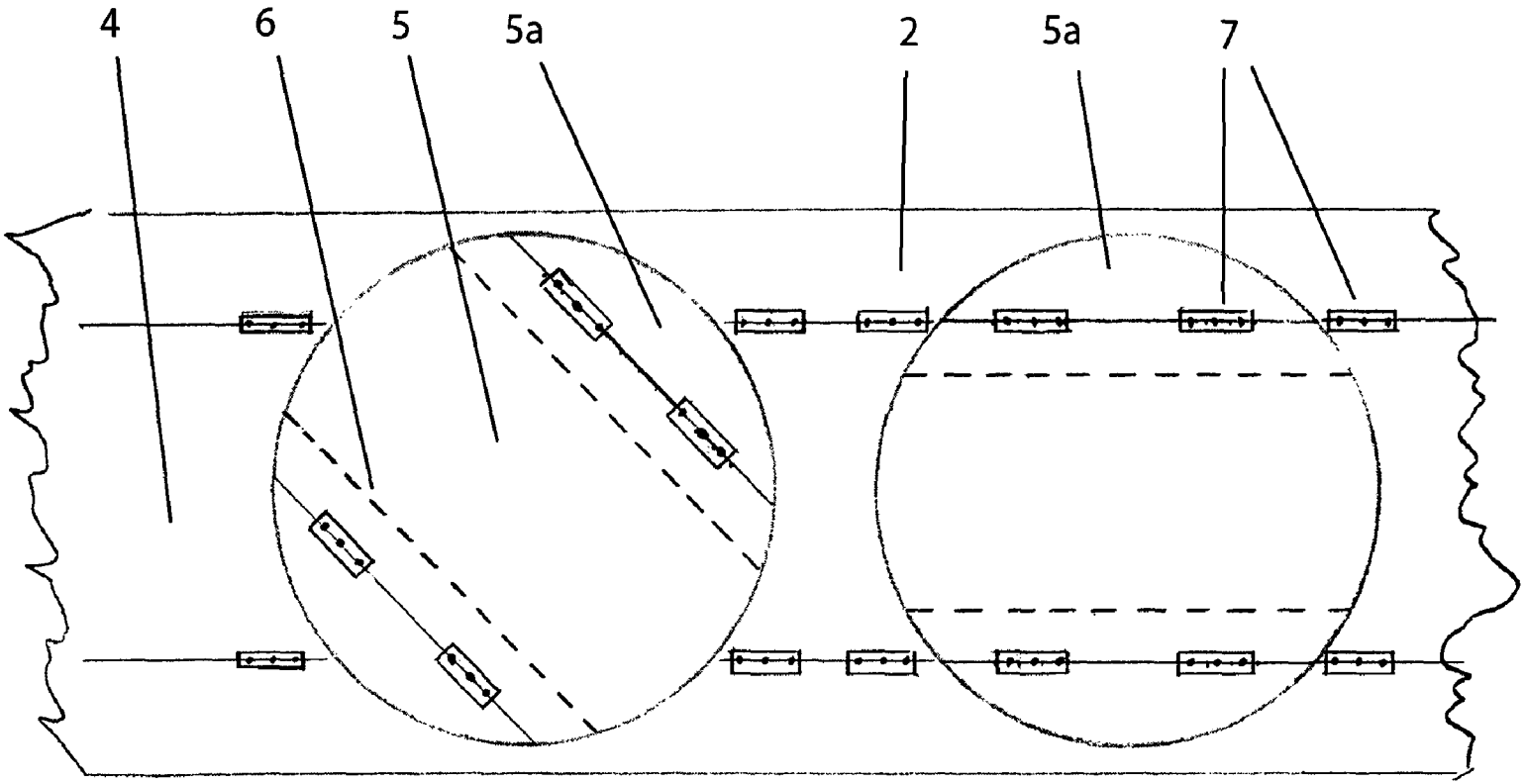
FIG. 2 Top view of two single-deck alignment units.

FIG. 2 shows two alignment units 5, 5*a* in detail. The left side of the drawing shows a partly turned position and the right side shows the driving position, in which the lower flaps with two movable wings 5*a* can be folded up, due to longitudinal hinges 7 that are aligned at a fixed base plate 4. On the alignment unit 5 marking lines 6 limit the driveway.

Figure 3:
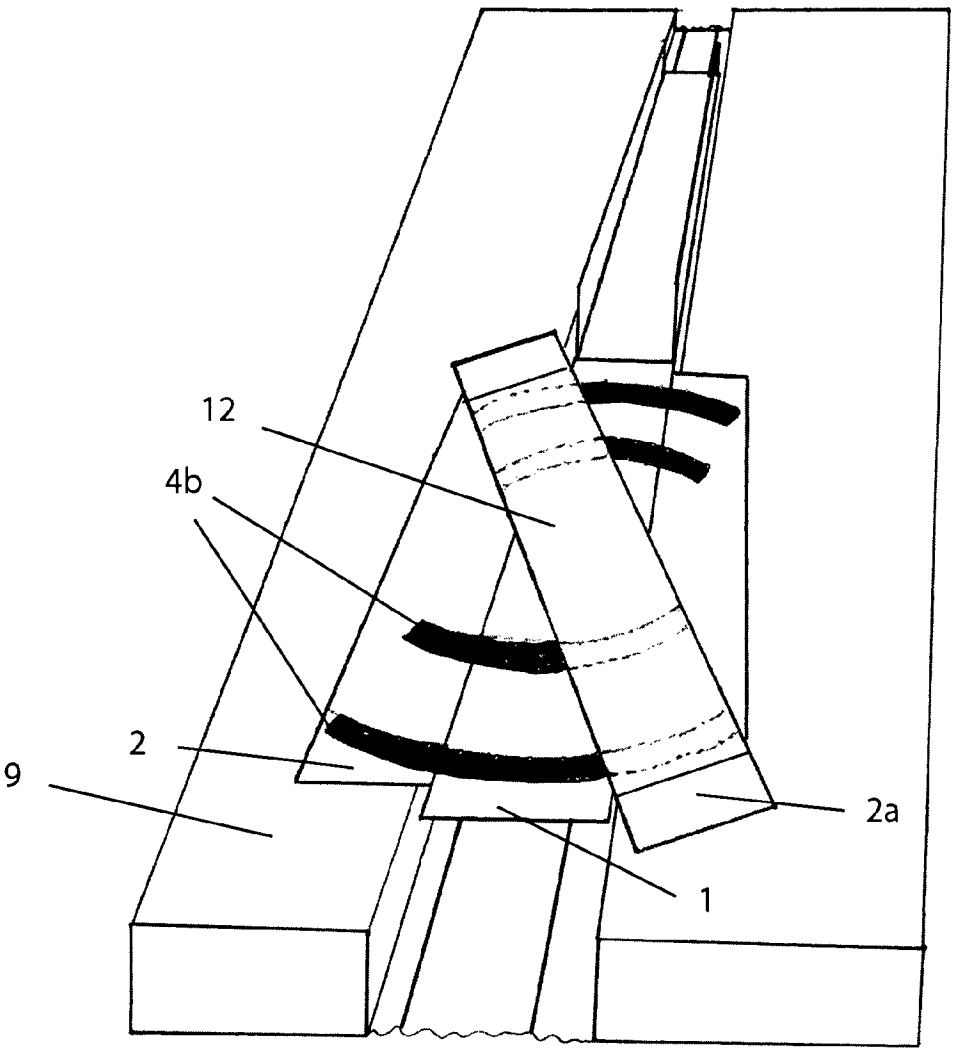
FIG. 3 Perspective view of a long transportation unit with alignment unit between ramps.

FIG. 3 shows a long form of the alignment unit 12. The two lower flaps bridge the gap between the transportation unit and the ramps 9 and comprise a carrier track 4*b* for the alignment unit 12.

An example for the utilization of this special form might be shipping a car on a motorail, wherein the length of the car significantly exceeds the width of the train:

For the vehicle to access the train at any point, it has to be brought to a stop in an oblique or transverse orientation and will then be aligned in the longitudinal direction. The fact that the foldable side walls are included in the loading surface, a larger loading area is available for the alignment of the car, so it can be loaded very easily, even though its length exceeds the width of the train in its running state.

The rotational alignment unit 5, 5*a*, 12 is constructed in such a way that once a vehicle is oriented in the longitudinal direction, its parts, namely the carrier track 4*b* and the wings 5*a*, which are located in the area of the side walls 2, are folded up with the side walls 2, so that all these mobile parts 2, 4*b*, 5*b* are fixed and the train is ready to start. Said parts 4*b*, 5*a* become part of the side walls 2, they partly replace them and contribute to their stabilization.

Even very long items, trucks for example, benefit from a loading process involving the side flaps. In this case, the alignment unit is not shaped as a full circle, the diameter of which would be too large. Instead, as FIG. 3 shows, an elongated shape is chosen, so that the side walls only function to bridge the gap between the ramp and the transportation unit 9, and also to form an alignment unit 12. In this version, due to the elongated shape of the alignment unit 12, the loading floor is not closed at all times.

Figure 4:
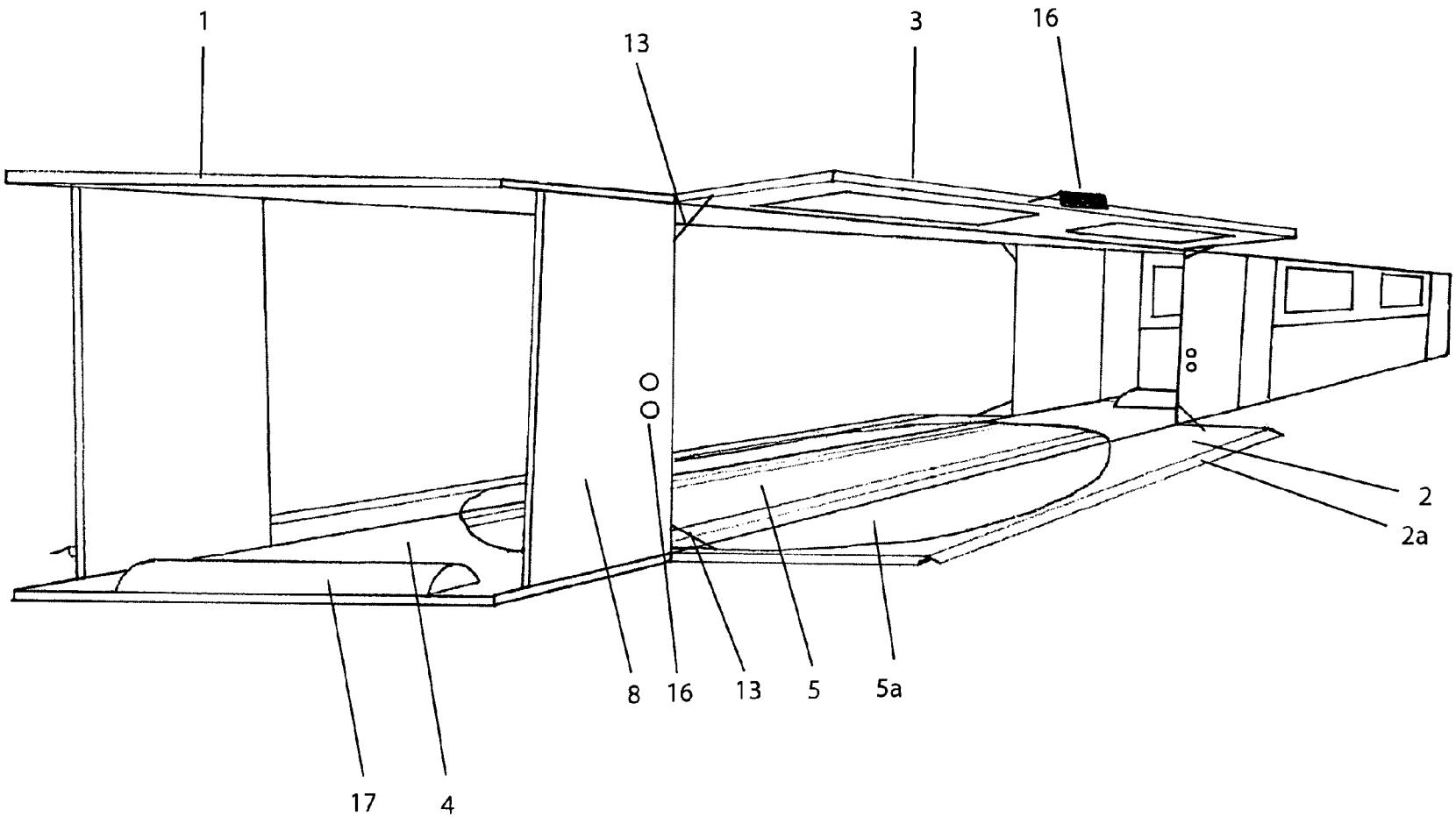
FIG. 4 Perspective view of a complete articulated train, partly open, partly closed.

FIG. 4 shows an overview of a transportation unit, which is designed as a closed articulated train 1, with opened or closed upper and lower flaps 2, 3. Traffic lights and/or display panels 16 are attached outside or inside the train within the fixed walls 8 next to the flaps 2, 3. The body and thus the fixed base plate 4 of the transportation unit 1 is preferably lowered, and the wheel case 17 which encloses the wheels with axle, a drive, a suspension, a brake and a coupling, partly projects above its level. Due to the width of the train, there is room between the fixed walls 8 and the wheel case 17 and the lowered floor of the base plate 4. This floor continues into the next section of the train, so persons can walk here. Furthermore, various technical details are shown, which facilitate and advantageously improve the operation of loading a car. Each detail is particularized in a separate drawing.

Figure 5:
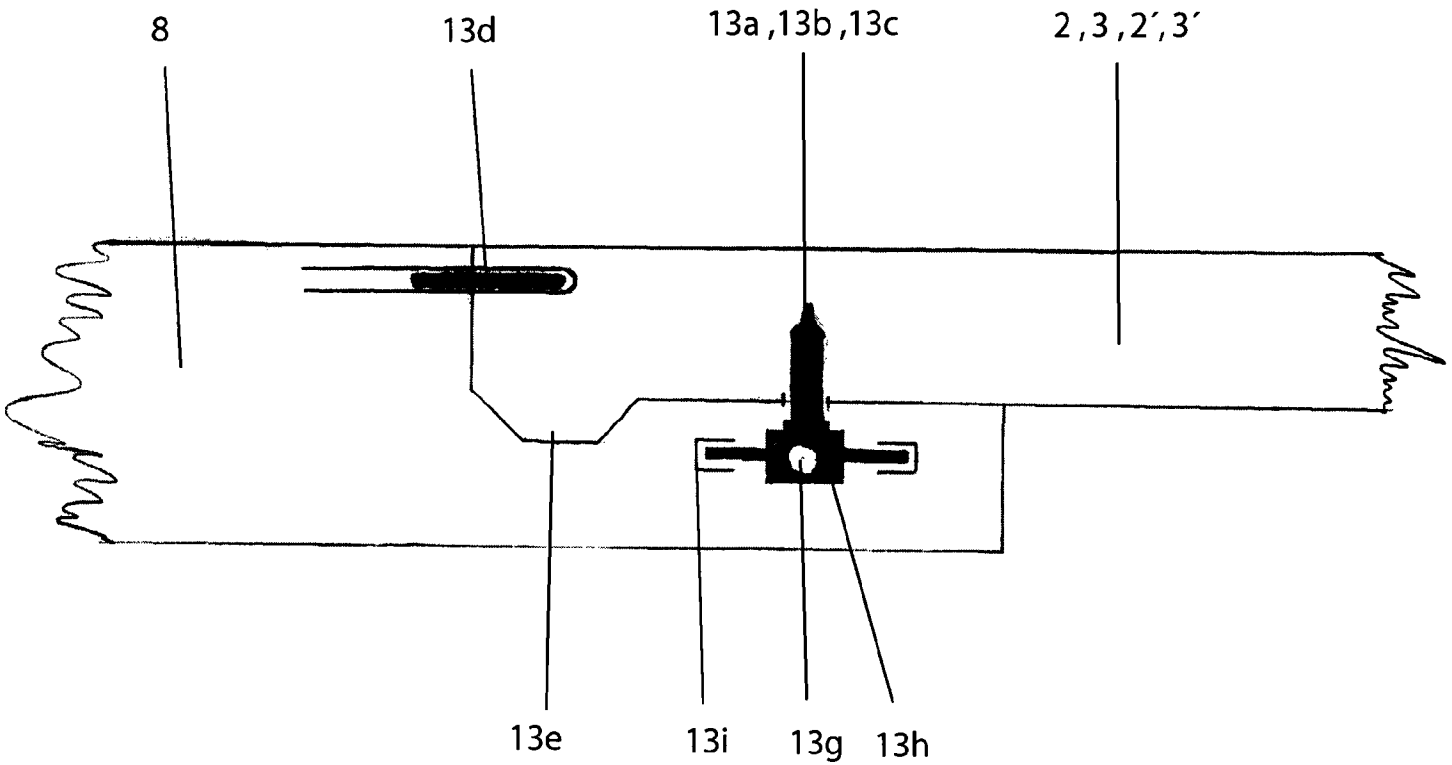
FIG. 5 Horizontal section through fixed side wall and flap with swivel mechanism.

FIG. 5 shows an example of a horizontal section through a fixed side wall 8 with a control device for swiveling. The side flaps 2, 3 are opened and closed by devices located in the fixed side walls 8. Turning a threaded rod 13*g* moves up and down a nut block 13*h* that is guided in a rail 13*i*, and connected to the flap 2 by a rigid or telescoping rod 13*a*, 13*b*, 13*c*, thereby closing and opening the flap. A bolt 13*d* in the locked position, and an engaged surrounding trapezoidal edge 13*e* are also shown.

Figure 6B:
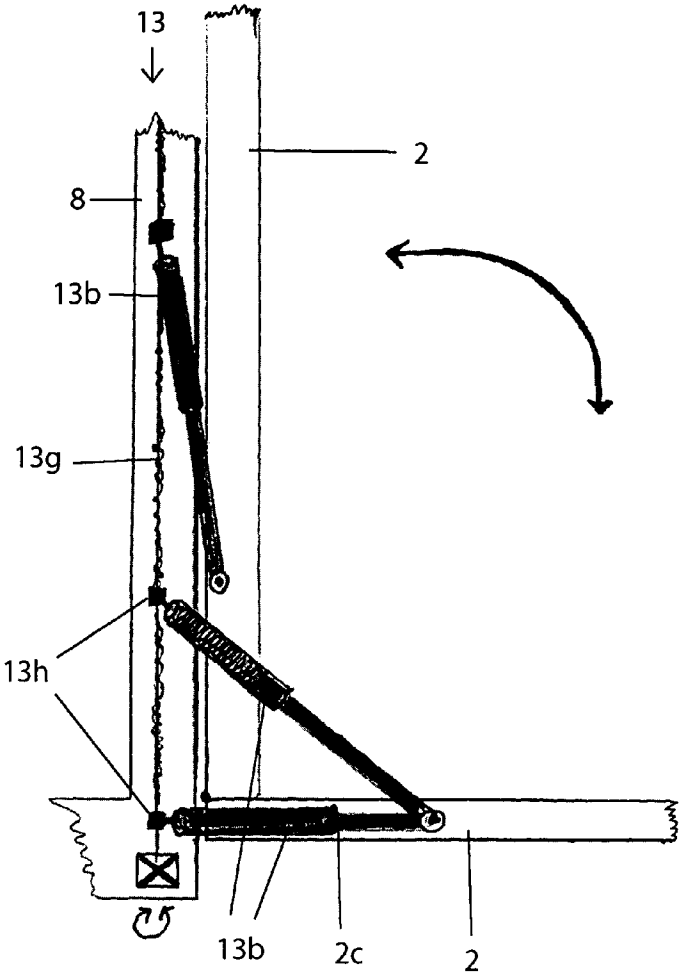
FIGS. 6*a*-6*b* Front views of various closing-opening mechanisms of the flaps, each in three positions.
Figure 6A:
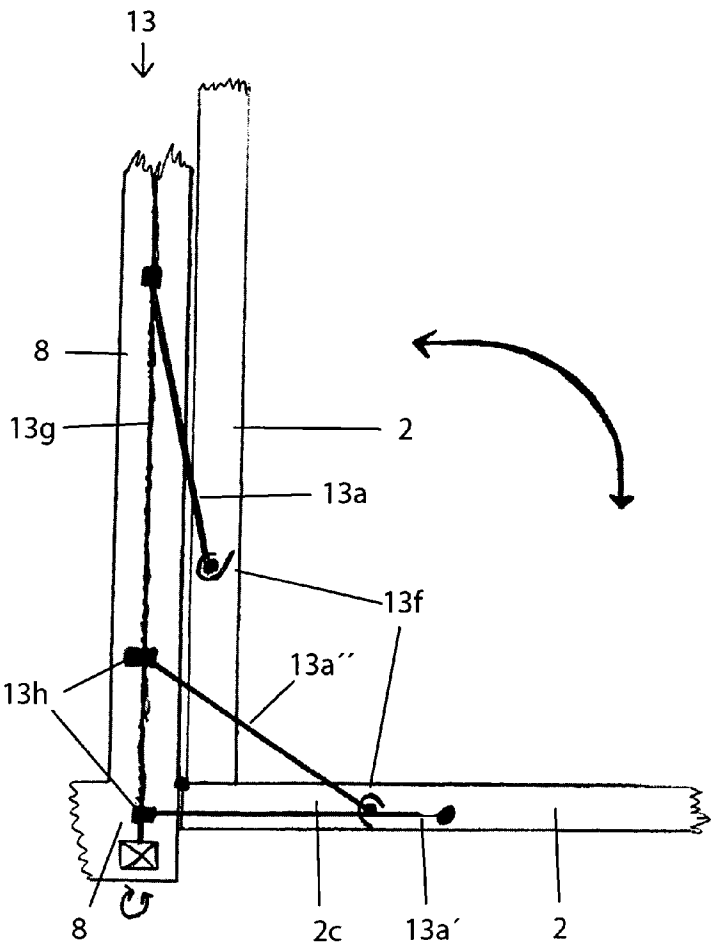
Figure 6D:
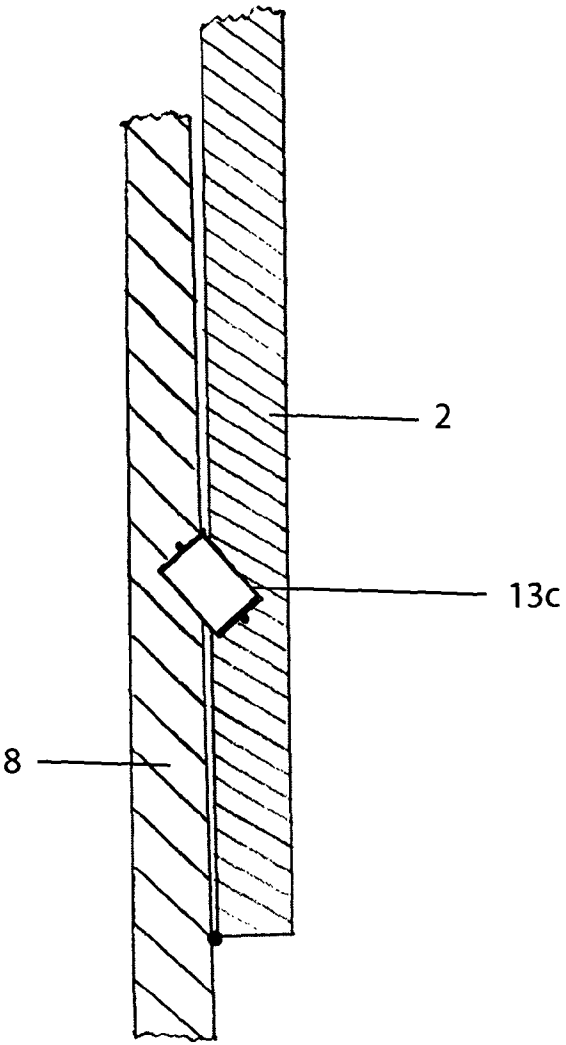
FIGS. 6*c*-6*d* Front view of a closing-opening mechanism of the flaps hydraulically folded away/up.
Figure 6C:
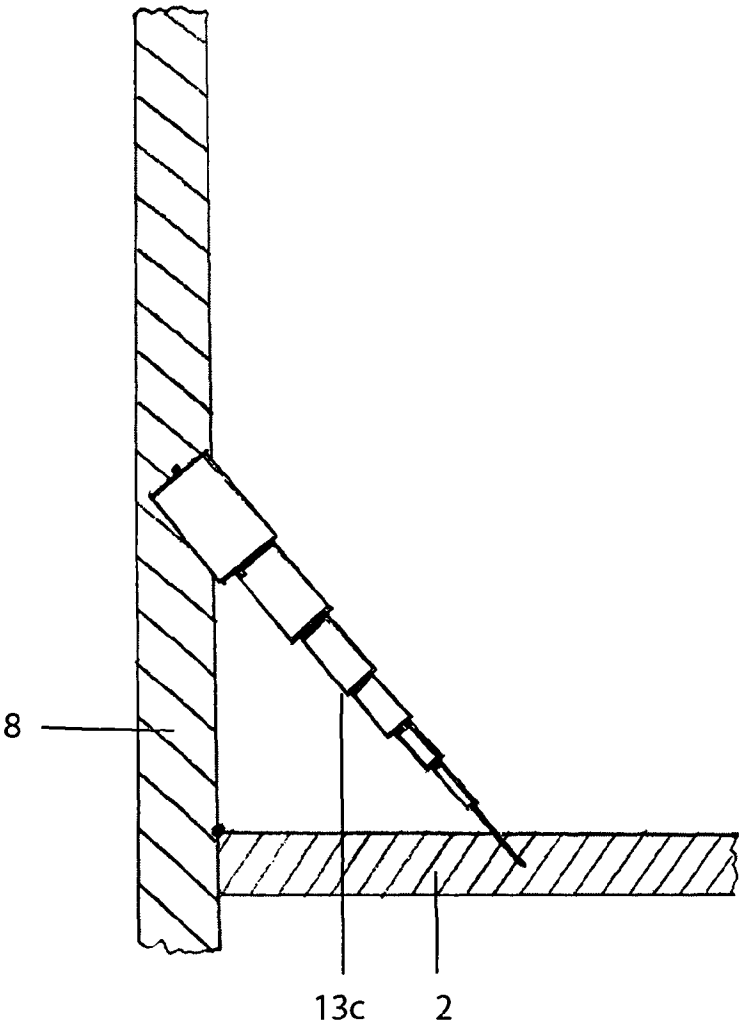

FIG. 6*a-c* are side views of the closing-opening mechanism 13, each with the flaps 2 in three different positions, with different versions of the rods 13*a*, 13*b*, 13*c*.

FIG. 6*a*. Inside the flap 2 the rod can move further and catches only in the position 13*a*" when the nut block 13*h* has reached a certain height. The end of the rod 13*a* is T-shaped and engages in a specially shaped hook 13*f* within the flap 2. These are shaped in such a way that the T-shaped end unlatches only when the flap 2 is open. The rods 13*a* are protected in recesses and/or openings 2*c* of the flap, with which they form a closed unit.

FIG. 6*b*. Alternatively, a telescoping rod 13*b* is provided between the nut block 13*h* and the lower flap 2. Instead of unlatching, the rod is pushed together and thus be recessed in the lower flap 2. An spring 13*b* embedded in the rod 13J extends it to its respective length.

FIGS. 6*c* and 6*d*. Alternatively, a multi-stage hydraulic cylinder 13*c* is mounted as a rod, which is placed between the flap 2 and a spot in the fixed side wall 8. It can not be recessed in the flap 2, but can be covered. A threaded rod is obsolete.

Figure 7B:
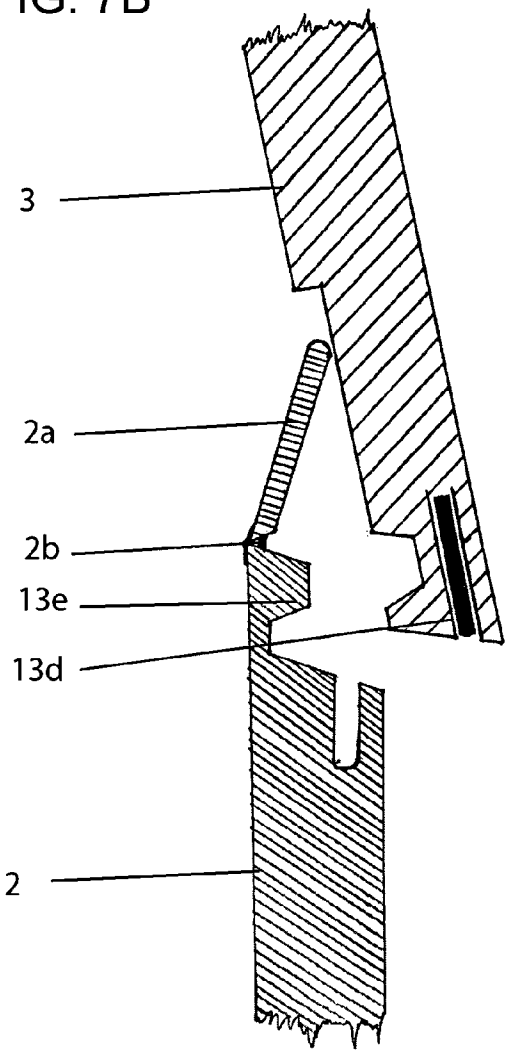
FIGS. 7*a*-7*b* Vertical section of the closing mechanism of the flaps before and after closing the side walls.
Figure 7A:
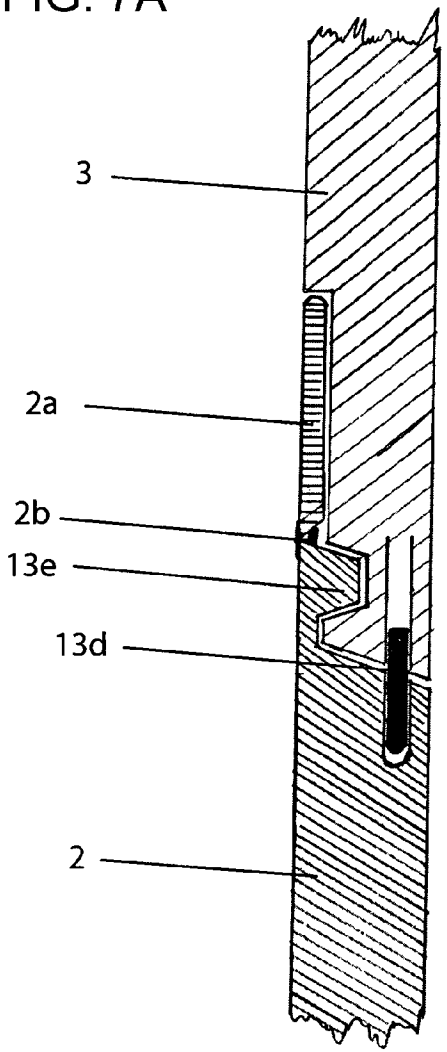

FIGS. 7*a* and 7*b* show an example of a closed or open locking mechanism between the lower and upper side flaps 2 and 3, in the closed or slightly open position. The surrounding closing edges 13*e* are trapezoidal and designed as a tongue and groove. By means of a locking bolt 13*d*, the closing edges are secured one against the other.

A flap 2*a*, 2*b* for driving on and off is held in a sealing position by springs. When closing, the flap for driving on and off 2*a* is pushed to a vertical position by the upper flap 3 and flushes with the upper flap 3.

Figure 9:
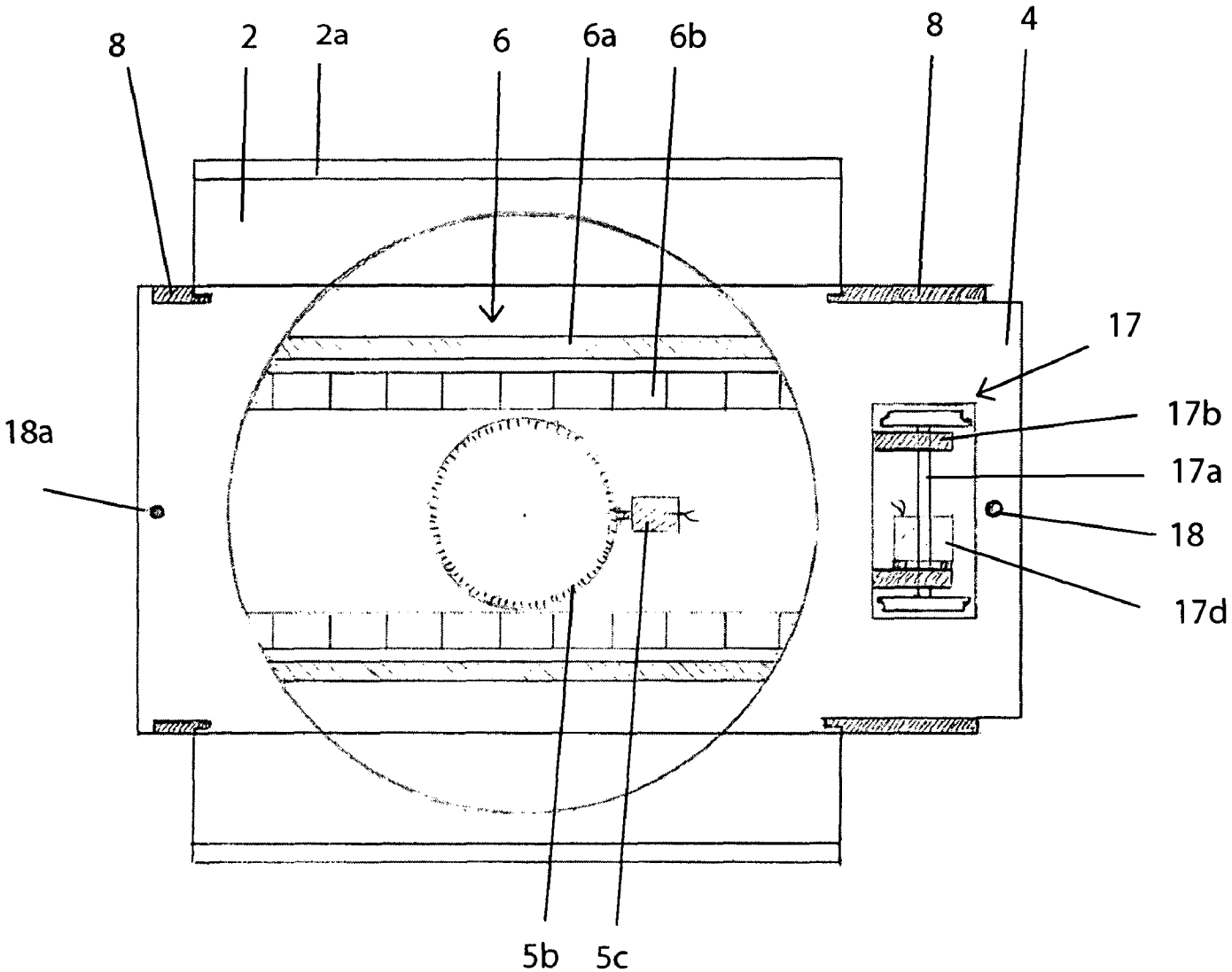
FIG. 9 Top view of a section of the train in loading position, partially opened floor and wheel case.

If the lower flap 2 is open, the flap for driving on and off 2*a* is pushed against the ramp by means of springs 2*b*, as shown in FIG. 9.

Figure 8:
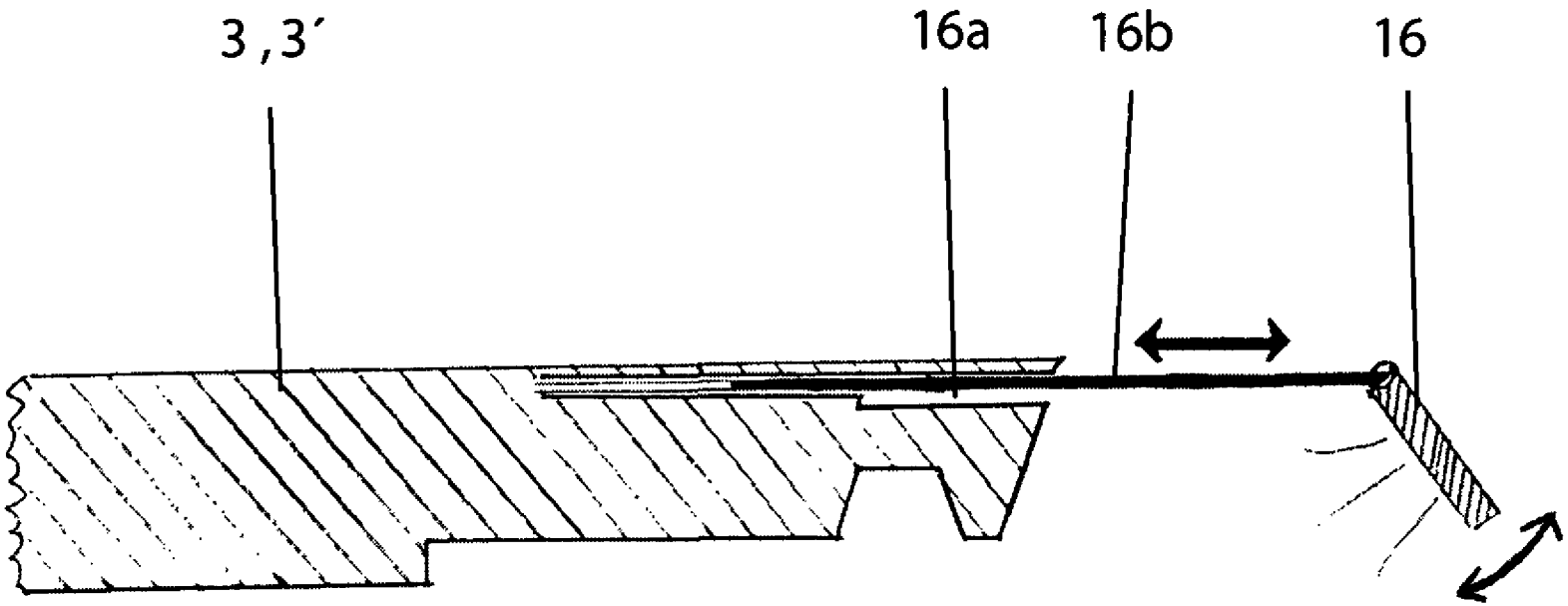
FIG. 8 Vertical section of the swiveled-in display apparatus.

FIG. 8 shows the upper flap 3 with an extensible display panel 16, in the extended state. A display panel 16 is movable on a holder 16*b* and is drawn in with it into an opening 16*a*. When the flap 3 is open, the display panel 16 is extended with and by means of the holder 16*b* at the front edge of the flap. Since the display panel 16 is mounted on the holder 16*b* with hinges, it folds down by its own weight. If the display board 16 is drawn in by the holder 16*b*, it folds up.

FIG. 9 shows a top view of a section of the train with an open center, and the roof and the upper flaps 3 removed.

The drawing shows the base plate (body) 4, side walls 8 fixed to it, lower flaps 2 and the alignment unit 5, 5*a*, with its markings limiting the driveway 6*a* and its series of pressure sensors 6*b*. Through the middle part of the alignment unit 5, a toothed ring 5*b* and a motor 5*c* can be seen.

The wheel case 17 and the springs 17*c* are not shown, only the chassis is exposed and visible from above. Movable bearing blocks 17*b* with the axle 17*a* and the wheels, are shown and an axis drive motor 17*d* is mounted on it. Also, a coupling 18 and a coupling mandrel 18*a* are shown.

Figure 9A:
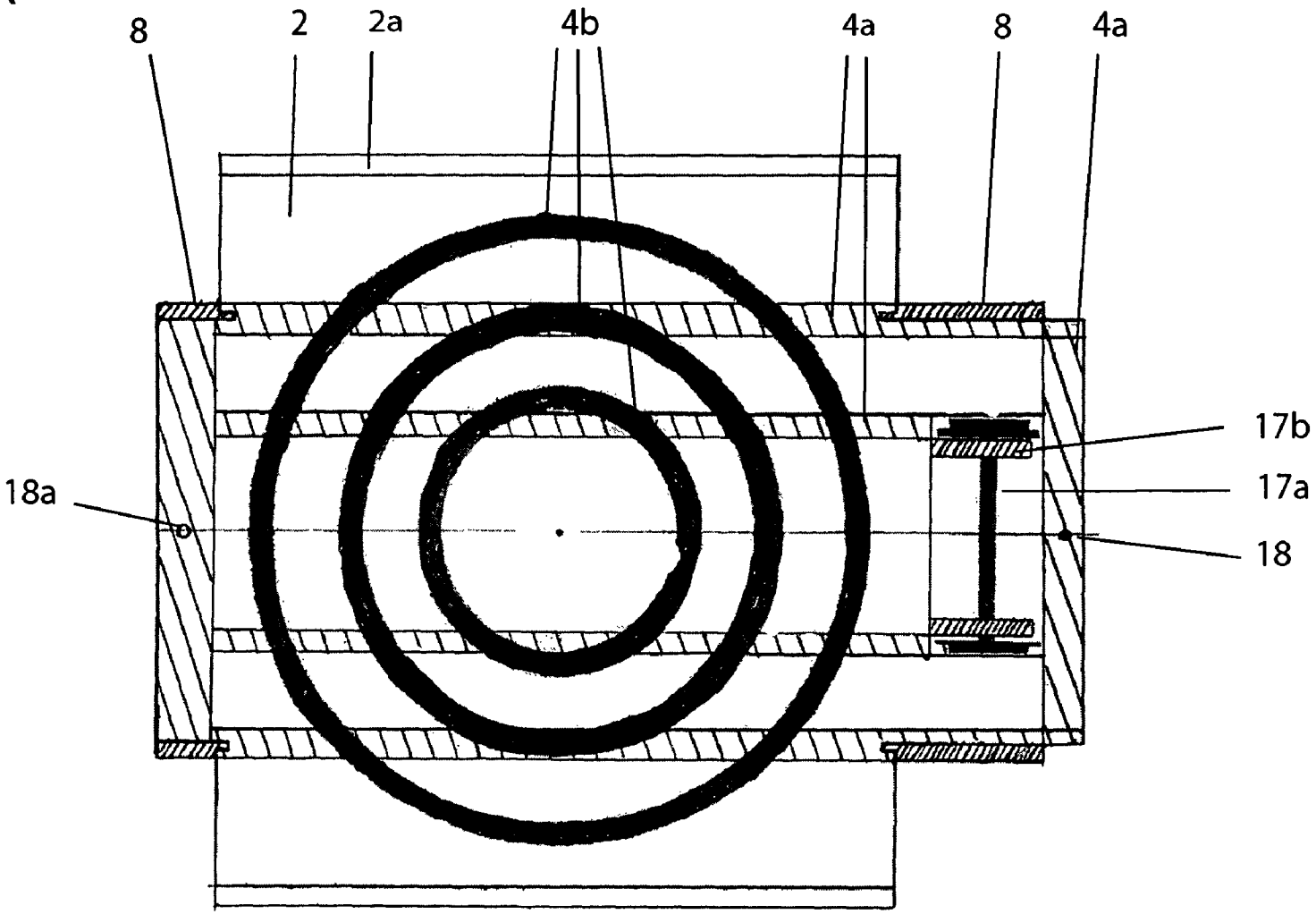

FIG. 9*a* shows a top view of a short train section. The alignment unit and a fixed base plate are omitted, only a body 4*a* with carrier tracks 4*b* is shown. Both are preferably in one plane and are firmly connected. The mobile bearing blocks 7*b* with the axle and the wheels 17*a*, the coupling 18 and the coupling mandrel 18*a*, and on both sides are lower flaps 2, each with ramp for driving on and off 2*a* and the fixed side walls 8 at all side ends are also shown.

Figure 9B:
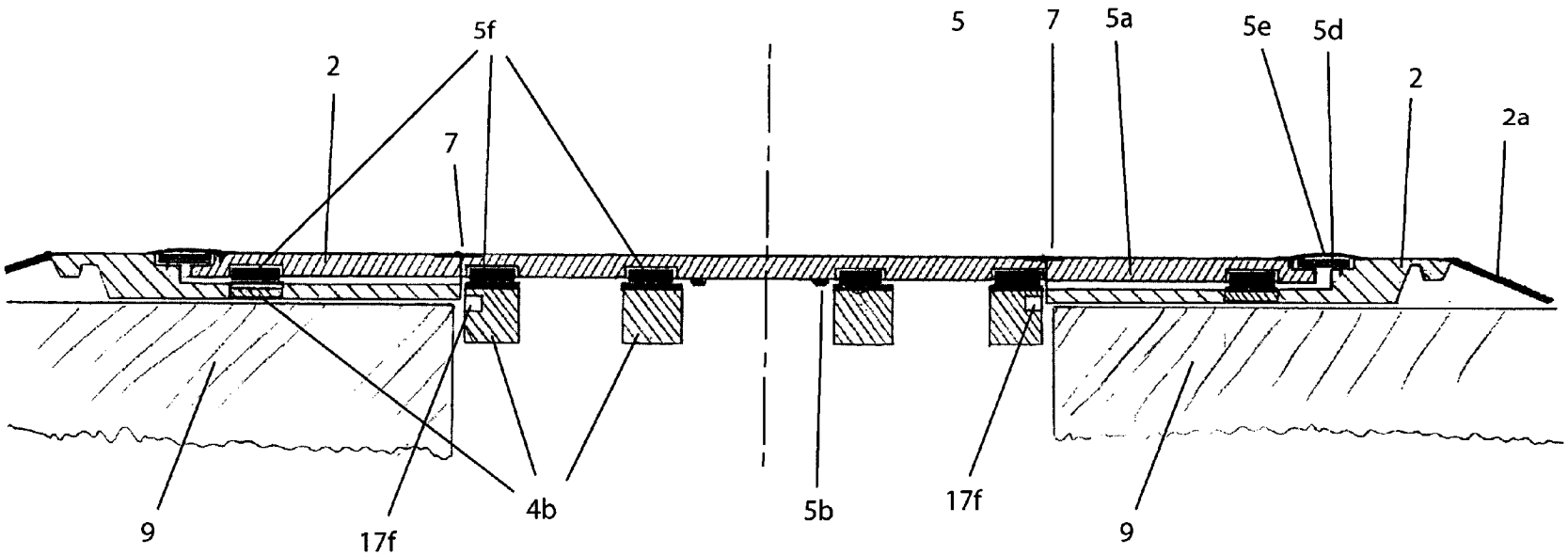
FIG. 9*b* Cross Section of a section of the train; flaps swiveled out.

FIG. 9*b* shows a cross section of the lower flaps 2, flaps for driving on a and off 2*a*, carrier tracks 4*b* and the alignment unit 5, 5*a* of an opened train section. Rollers 5*f* are attached underneath the alignment unit 5, 5*a*, which run on the carrier tracks 4*b*. The lower flaps 2 rest on the ramps 9. The alignment unit 5, 5*a* is surrounded flush by a ring 5*d*, which is interrupted at the folding edges. At the edge of the alignment unit 5 a surrounding cuff 5*e* is mounted, which extends across surrounding ring 5*d*. Additionally, hinges 7 and the gear ring 5*b* are shown.

Figure 10:
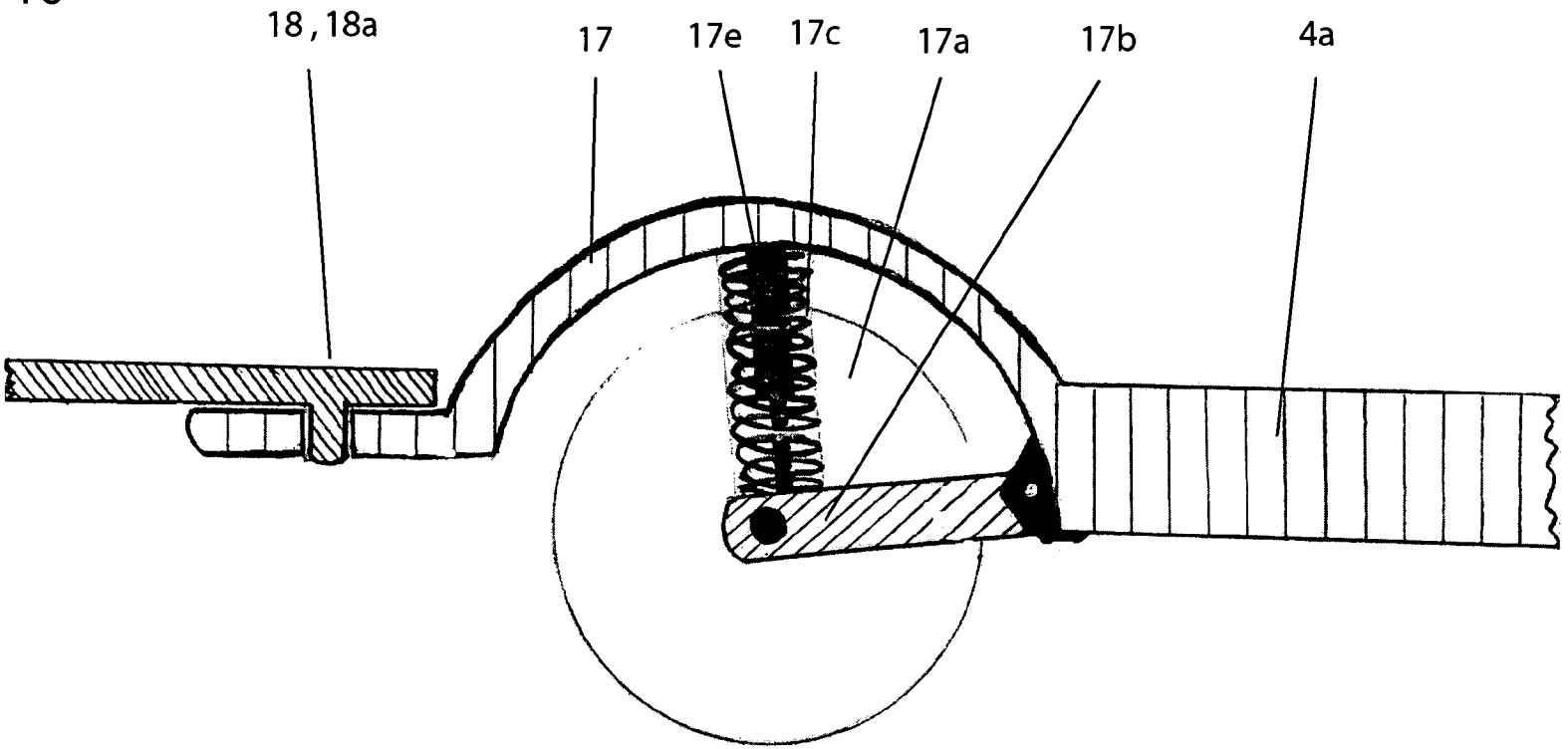
FIG. 10 Vertical section of the wheel case.

FIG. 10 shows an example of a cross section of a wheel case 17. The wheel case 17 is stable and supports the spring load. The axle 17*a* is supported by two vertically movable bearing blocks with axle bearings 17*b*. The bearing blocks 17*b* are each attached by a hinge to the body 4*a*. For axle suspension, springs 17*c* and/or a shock absorber are mounted between the bearing blocks 17*b* and the wheel case 17. A mounted coupling 18 with a coupling mandrel 18*a* are also shown. Advantageously, the chassis is supported on the wheel case 17 with at least one double acting hydraulic adjuster 17*e*. This can either be controlled as an active vibration damper, or, when the wagon is stationary, can be used as a height adjustment means, which in conjunction with a ramp sensor 17*f*, FIG. 9*b*, adjusts the base plate 4 at the level of the top edge of the ramp 9 and which maintains this level also in the case of a changing load due to the driving on and off of the vehicle 11. This way, the fold-out side panels are fully brought to rest on the ramp 9 and their hinge area in particular is protected from high loads.

The hydraulic actuator 17*e* is advantageously driven at its two ports with a 2-channel 2-way valve with intermediate locking position. The control device of the flap comprises a running/stationary signal and level signals from the ramp sensor 17*f* and from a position sensor 17*a* of the axle in the wheel case 17, with these sensors in effect alternatively and evaluated by appropriate programs. Preferably, hydraulic actuators 17*e* and associated ramp sensors 17*f* are arranged respectively on both sides, so that a transverse inclination is prevented.

Figure 11:
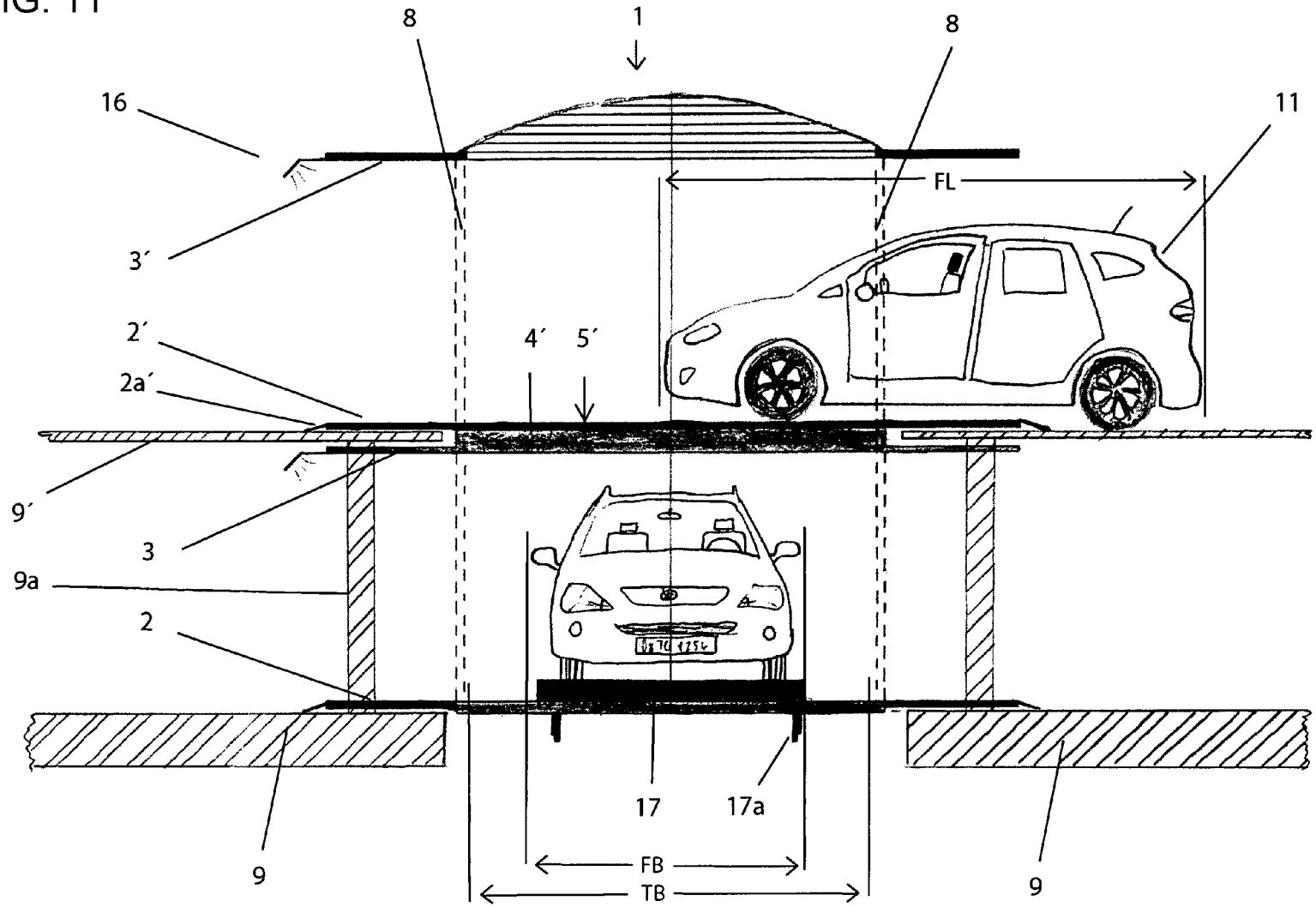
FIG. 11 Cross section of a double-deck train at its loading position between double ramps.

FIG. 11 shows a cross section through a double-deck train 1. It is located between ramps 9. All flaps 2, 3, 2', 3' are open. Columns 9*b* are placed where there are no flaps, to support of the upper ramp 9*a*. The upper vehicle 11 is driving onto the train, the lower vehicle 11' has already been turned. The fixed side walls 8, the wheel case 17, the wheels with the axle 17*a* and an extended display panel 16 are also shown. The upper floor has a middle plate 4', which is equipped with an alignment unit 5. The upper and lower flaps 2', 3' on the upper deck are similar to those on the lower deck.

The novel transportation device has the following advantageous features:

that by the arrangement of both mobile and stationary parts of the flaps and the floor flatness is maintained during the entire loading process, and also no breaks in the form of gaps or holes within the entire area of the transportation unit with its flaps open;

that with double or multi-level ramps simultaneous multi-level loading is possible; that each loading unit can be loaded independently, without the other units being affected in any way;

that parts of a rotational disk of the alignment unit are linked by means of hinges or other flexible connections, so that, in a defined position of the disc, in which all axes are in alignment, these parts can be moved like the flaps of a transportation unit;

that all pieces of the alignment unit are automatically fixed or loosened with the transportation unit by closing and opening the side flaps;

that the parts of an alignment unit replace parts of the floor and the side flaps of a transportation unit;

that the alignment unit consists of one piece, and possesses the necessary flexibility in the areas that have to be bent;

that the function of the flaps transportation unit have the function of bridging the gap between the transportation unit and the ramp, and support the carrier rail for the alignment unit;

that a circular disk of the alignment unit, which can be rotated centrally, and on two opposite sides has sections that can be folded by means of hinges or due to the flexibility of the material, has several functions (rotate, open-close, fix, replace parts) that are carried out by means of appropriate actuators;

that carrier tracks are placed in flaps of a transportation unit;

that an alignment unit is surrounded flush by a ring, which is interrupted at the folding edges, and that at the edge of the of the alignment unit a surrounding cuff is mounted, which extends across surrounding ring;

that threaded rods are mounted in the side walls of a transportation unit, which move nut blocks that are guided in rails up and down, and that the nut blocks are connected to the flaps by a rod, by which they are opened and closed;

that the ends of the rods that connect the nut blocks are T-shaped, unlatch when the flap is opened and are sunk in a recess/opening in the lower flap;

that a rod, which connects the nut blocks with the flaps is collapsible, is held in an extended position by a spring and is recessed in an opening in the lower flap;

that the lower flaps have recesses/openings for receiving rods;

that hooks in the flaps are specially shaped and thus a rod unlatches when the flap is open;

that multi-stage hydraulic cylinders attached in the side walls open and close the flaps;

that the closing areas between the flaps and between flaps and walls are trapezoidal and engage;

that, when the flaps are closed, bolts lock the flaps with each other or with the walls;

that a flap for driving on and off that is hinged on the lower flap and is forced to a defined angular position by means of springs;

that a display panel is hinged and movable on a rail/holder and that together they are placed inside the upper flap of a transportation unit; when the flap is open, the display panel is extended by means of the rods at the front edge of the flap, and (by its own weight) it swings down to a position in which it can be seen well by the driver of the vehicle; that traffic lights/display panels are attached in the fixed walls next to the flaps, at the outside and inside of the train;

that markings and pressure sensors are placed on an alignment unit;

that the axle with wheels, drive and brake (partly) is surrounded by a wheel case, which projects above the level of the base plate (the floor) of a transportation unit;

that a wheel case receives the spring load of a transportation unit via springs/shock absorbers;

that the axle is supported in blocks, which are hinged at the body/fixed base and that springs/shock absorbers located between the axle blocks and the wheel case provide the suspension for the transportation unit;

that hydraulic height adjusters, mounted between the axle blocks and the wheel case, stabilize the train during the loading process and adjust its height using ramp sensors.

The transportation unit can advantageously be designed as an articulated train, wherein especially for double-deck trains, it is advantageous that a structural wall is supported on the wheel case.

LIST OF REFERENCE SYMBOLS

1 train/transportation unit
2 lower flap, 2*a* flap for driving on a and off, 2*b* spring, 2*c* recess/opening,
2' lower double-deck flap, 2*a'* upper flap for driving on and off
3 upper flap, 3 windows, 3' upper double-deck flap
4 fixed base plate, 4*a* body, 4*b* carrier track, 4' middle plate with alignment unit 5'
5 alignment unit, 5*a* wing right-left, 5*b* toothed ring (live ring), 5*c* motor,
5*d* surrounding ring, 5*e* cuff, 5*f* rollers, 5' alignment unit in 4'
6 driveway limit, 6*a* driveway limit markings, 6*b* pressure sensors
7 hinges
8 fixed side walls
9 ramp, 9*a* columns, 9' upper ramp
10 rails
11 vehicle to be transported, bottom vehicle, 11' top vehicle
12 oblong alignment unit
13 closing-opening mechanism of the flaps, 13 rod with T-shape, 13*b* telescopic rod
13*c* rod as a multi-stage hydraulic cylinder, 13*d* bolts for locking,
13*e* surrounding closing edge, trapezoidal, 13*f* specially shaped hook,
13*g* threaded rod, 13*h* nut block, 13*i* guiding rail, 13*j* spring in rod
14 closing/opening mechanism of the upper flaps
15 passage
16 display panel, 16*a* opening in upper flap, 16*b* holder
17 wheel case, 17*a* wheels with axle, 17*b* bearing block with axle bearings,
17*c* springs/shock absorbers, 17*d* driving motor/axle motor and brake,
17*e* hydraulic height adjuster, 17*f* ramp sensor
18 coupling, 18*a* coupling mandrel
FL vehicle length
FB vehicle width
TB width of the transportation unit

The invention claimed is:

1. A transportation unit, car or train, comprising:
a floor;
a carrier track;
a usable width;

at least one ramp;

flaps respectively pivoting onto said at least one ramp; and at least one plate-shaped alignment unit rotatable about a vertical axis for receiving a vehicle having a vehicle length exceeding said usable width and a vehicle width not projecting beyond the transportation unit, for taking the vehicle from said at least one ramp and for aligning the vehicle, said alignment unit being mounted on said floor for rotation on said carrier track, and said alignment unit having pivoting wings;

said carrier track extending into said pivoting flaps for supporting said pivoting wings of said alignment unit and for supporting said alignment unit in a rotated and partially projecting state.

2. The transportation unit according to claim 1, wherein said carrier track includes several concentric circles and/or segments of a circle.

3. The transportation unit according to claim 1, wherein said wings are hinged, and said plate-shaped alignment unit covers a central circular area of a width of the transportation unit and extends into said flaps onto said hinged wings that complete a circle.

4. The transportation unit according to claim 3, wherein said floor is defined by a base plate, and when said flaps are folded out, said alignment unit with said wings is positioned in said flaps and said base plate, flush at a top.

5. The transportation unit according to claim 3, wherein said floor is defined by a base plate, said pivoting flaps are linked axially parallel at said base plate or at said alignment unit, and said wings are linked axially parallel at said alignment unit.

6. The transportation unit according to claim 5, wherein said wings are part of, bordered by and supported by said flaps and are locked when folded up in a non-rotated position.

7. The transportation unit according to claim 1, which further comprises fixed side parts and closing and opening mechanisms supported at said fixed side parts, said flaps being linked to said closing and opening mechanisms.

8. The transportation unit according to claim 7, wherein said closing and opening mechanisms include a motor-driven vertical spindle drive having a nut block linked to a flap by a rod.

9. The transportation unit according to claim 8, which further comprises a hook, being upwardly open and being able to be recessed, for linking said rod to said flap.

10. The transportation unit according to claim 8, wherein said rod is telescopic, extended by a spring and recessed in a folded out flap when said nut block is in a low position.

11. The transportation unit according to claim 7, wherein said closing and opening mechanisms include a multi-stage hydraulic cylinder-piston assembly.

12. The transportation unit according to claim 1, wherein said flaps include flaps having beveled edges for driving on and off.

13. The transportation unit according to claim 4, which further comprises a ring and an elastic cuff sealing said wings and said alignment unit against said base plate and said flaps.

14. The transportation unit according to claim 1, wherein the transportation unit has different levels including a medium level having a middle plate with foldable side parts and an alignment unit.

15. The transportation unit according to claim 1, which further comprises a closing and opening mechanism, said flaps including upper and lower flaps, said upper flap to be operated with said closing and opening mechanism linked at a top above each lower flap.

16. The transportation unit according to claim 15, which further comprises display devices, traffic lights or a display panel each located at a respective upper flap and activated when said respective upper flap is folded up, said display panel being maintained on a drawing-in device in an opening in said upper flap and linked by a holder.

17. The transportation unit according to claim 15, which further comprises a trapezoidal interlocking closing edge, said lower and upper flaps respectively engaging with said trapezoidal interlocking closing edge upon being closed.

18. The transportation unit according to claim 17, which further comprises fixed side walls, and controllable latches firmly locking said flaps with each other and with said fixed side walls.

19. The transportation unit according to claim 15, which further comprises flaps for driving on and off, and a spring-loaded, recessed and covered connection between said flaps and said flaps for driving on and off.

20. The transportation unit according to claim 1, wherein said floor is defined by a base plate, a body supports said base plate and has wheel cases formed therein extending beyond said base plate at a distance from said alignment unit, and wheels are disposed in said wheel cases and suspended elastically on an axle supported against a wheel case by a spring.

21. The transportation unit according to claim 20, which further comprises at least one ramp sensor of said body supplying a signal, a bearing block with axle bearings, and a hydraulic adjuster connecting said bearing block to one of said wheel cases or said body, said hydraulic adjuster in conjunction with the signal of said at least one ramp sensor of said body, during loading of the vehicle, adjusting a height of said body to a level of a top edge of said at least one ramp causing said wings to lie flat on said at least one ramp.

22. The transportation unit according to claim 21, wherein said hydraulic adjuster is controlled during riding to reduce vibration.

23. The transportation unit according to claim 1, wherein said alignment unit has a bottom carrying a toothed ring, and a motor drives said toothed ring.

24. The transportation unit according to claim 1, wherein said alignment unit carries a travel path or driveway limit.

25. The transportation unit according to claim 24, wherein said travel path includes at least one of lines or a series of pressure sensors or optical or electro-magnetic detection devices capturing an off-center or on-center state of a vehicle driving on said travel path and sending a signal to a driver of the vehicle.

* * * * *